United States Patent [19]

Buchas

[11] Patent Number: 4,604,616

[45] Date of Patent: Aug. 5, 1986

[54] APPARATUS FOR PROGRAMMING AN ELECTRICALLY ERASABLE PROGRAMMABLE READ-ONLY MEMORY

[75] Inventor: Gerald L. Buchas, Bristol, Conn.

[73] Assignee: The Arthur G. Russell Company, Incorporated, Bristol, Conn.

[21] Appl. No.: 557,192

[22] Filed: Dec. 1, 1983

[51] Int. Cl.[4] ..... G09G 3/04

[52] U.S. Cl. ..... 340/756; 340/789; 340/798; 340/799

[58] Field of Search ..... 340/700, 706, 709, 756, 340/789, 798, 799, 752; 365/230

[56] References Cited

U.S. PATENT DOCUMENTS

| | | | |
|---|---|---|---|
| 4,216,471 | 8/1980 | Akred, Sr. | 340/756 |
| 4,389,641 | 6/1983 | Nakanishi et al. | 340/709 |
| 4,408,306 | 10/1983 | Kuo | 365/230 |

FOREIGN PATENT DOCUMENTS

| | | | |
|---|---|---|---|
| 0900316 | 1/1982 | U.S.S.R. | 340/799 |

OTHER PUBLICATIONS

"Using EPROMs for CRT Screen Refresh", Electronic Product Design, May 1981.

*Primary Examiner*—Gerald L. Brigance
*Assistant Examiner*—Jeffery A. Brier
*Attorney, Agent, or Firm*—McCormick, Paulding and Huber

[57] ABSTRACT

An electrically erasable programmable read-only-memory (EEPROM) programmer uses an alphanumeric visual display system having a multi-character station visual display device for displaying message units made up of a number of characters and the characters are stored as bytes of data in memory cells of an EEPROM forming a part of the display system. Individual characters within a message unit are selected by selectively generating a character address corresponding to a character display station position in a message unit and the selected character is identified by a cursor appearing in the associated character display station. A keyboard is provided for entering data representative of a character to be written into memory. The involved EEPROM cells are then conditioned by related means to receive and retain the entered data. The data so written into the EEPROM is displayed on the visual display device in alphanumeric form for immediate and accurate verification.

7 Claims, 13 Drawing Figures

APPARATUS FOR PROGRAMMING AN ELECTRICALLY ERASABLE PROGRAMMABLE READ-ONLY MEMORY

BACKGROUND OF THE INVENTION

This invention relates to electrically erasable programmable read-only-memory (EEPROM) semiconductor memory device programmers and deals more particularly with an EEPROM programmer in which the EEPROM is part of an alphanumeric display system.

EEPROM nonvolatile semiconductor memories are used extensively as program stores in microprocessor based systems due to their ability to be reprogrammed electrically at an on-site location without removal from in-service equipment. The techniques for reprogramming EEPROMs in such microprocessor systems are generally well known in the art. However, in non-microprocessor based systems, the EEPROM must often be removed from the in-service equipment and memory alteration must be accomplished using programming apparatus and techniques also well known in the art.

Generally, in both instances above, the data to be programmed is entered into the EEPROM in an a binary coded format. In order to verify the entered data, the contents of each cell location in the EEPROM must be read and compared to the desired code assigned to the corresponding cell location. The verification procedure is time consuming and subject to error when done manually because a person doing the verification must often use an encoded listing rather than a much simpler to read and understand alphanumeric representation of the code. The entries may also be verified by a computer-based system which contains a listing of the encoded information for each cell and which can access each cell location and compare the actual cell contents to the listed encoded information. However, such computer-based systems are generally remotely located from the equipment site and are costly. Also the use of such systems generally requires additional apparatus to generate the code listing to be read.

A feature of the present invention is that an EEPROM can be programmed using an EEPROM based alphanumeric display system.

Another feature of the present invention is that the programming of an EEPROM and the verification of programmed data can be accomplished without the necessity of additional and often costly apparatus.

Another feature of the present invention allows the user to verify a data entry by viewing the alphanumeric character representation of the coded entry on the display device of the display system.

Other features and advantages of the present invention will be apparent from the following written description and from the drawings forming a part hereof.

SUMMARY OF THE INVENTION

The present invention resides in an apparatus for programming an EEPROM forming part of an alphanumeric display system having a multi-character station visual display device for displaying message units each made up of a plurality of characters. The characters comprising a number of message units are stored as data bytes in memory cells of the EEPROM. The EEPROM has two groups of address terminals. The first group may be energized by a binary coded message unit address signal to selectively address any one of the stored message units. The second group may be energized by a binary coded character address signal to selectively address any one of the character storage locations of the selected message unit. The display system includes a first message unit addressing means for generating a message unit address signal to select any one of the message units of the EEPROM. Also included in the display system is a first character addressing means for generating a character address signal to select one of the characters of the selected message unit. A second message unit addressing means is provided in the programming apparatus. Means are also provided for selectively connecting and disconnecting the EEPROM to or from the first message unit addressing means and for simultaneously disconnecting or connecting the EEPROM from or to the second message unit addressing means so that stored message units are selected by one or the other of the first and second message unit selecting means. Similarly, a second character addressing means is provided in the programmer and means are provided for selectively connecting or disconnecting the EEPROM to or from the first character addressing means and for simultaneously disconnecting or connecting the EEPROM from or to the second character addressing means so that character storage locations are selected by one or the other of the first and second character addressing means. A comparator compares a character address generated by the first character addressing means to a character address generated by the second character addressing means and produces an ADD MATCH signal when the two generated addresses match. An indicator character signal representative of a cursor is generated by related means in response to the presence of the ADD MATCH signal and the generated cursor character is displayed in the character display station position corresponding to the character address generated by the second character addressing means. The programming apparatus also includes means for conditioning the EEPROM character storage location addressed by the second character addressing means to receive a data byte. An alphanumeric character generating means generates a signal representative of an alphanumeric character to be written into a conditioned storage location. The programming apparatus further includes storage location altering means responsive to the conditioning means and to the alphanumeric character generating means to electrically alter the character storage location addressed by the second character addressing means to cause the character storage location to retain the generated alphanumeric character signal.

BRIEF DESCRIPTION OF THE DRAWINGS

FIG. 4 is a diagram, partly in block form and partly in schematic form, of the EEPROM programmer of FIGS. 1 and 3 shown in greater detail.

DETAILED DESCRIPTION

Figure 1:
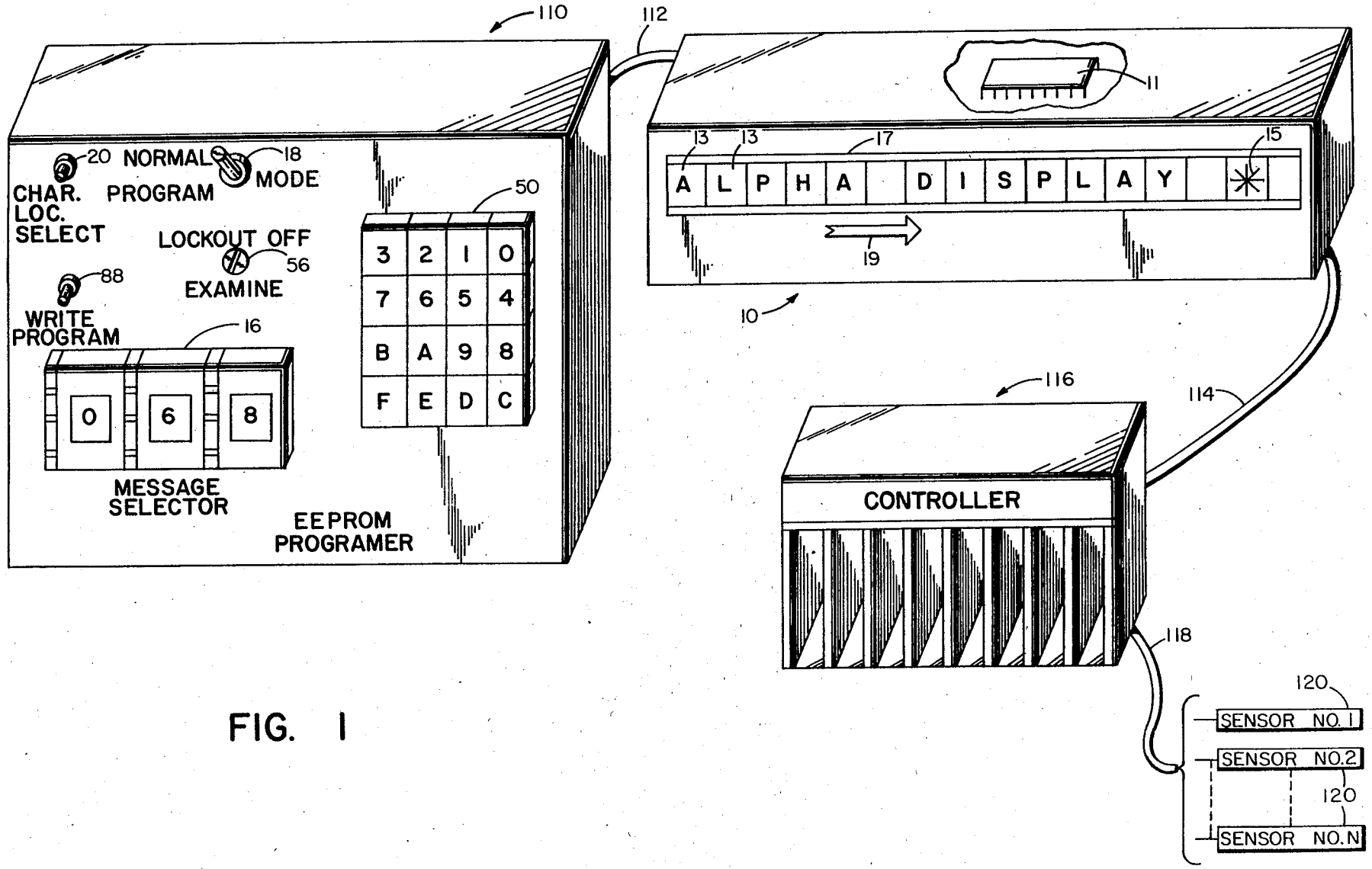
FIG. 1 shows a perspective view of an EEPROM programming apparatus or programmer embodying the present invention connected to an alphanumeric display system.

By way of background, an alphanumeric display system that may be used with an EEPROM programmer embodying the present invention is manufactured by The Arthur G. Russell Company, Incorporated, Bristol, Connecticut. The above-referenced system is disclosed in U.S. Pat. No. 4,381,505, issued Apr. 26, 1983, and in U.S. patent application Ser. No. 06/520,630, filed Aug. 5, 1983, both of which are assigned to the same assignee as the present invention. The system has a display device with a row of character stations at each of which a character may be displayed in response to a set of signals applied to the character station. A memory means, such as an EEPROM, stores data representing a number of complete messages wherein a complete message comprises either: (1) a single message unit which can be displayed as a single row of characters, or (2) a plurality of message units each of which is displayed as a single row of characters and which units are scrolled in a timed relationship to present the complete message. The messages are normally selected by a selecting means and the stored data representing a selected message is applied in a one character to one display station relationship to the character stations of the display device to cause the display of a single message unit at a time as a single row of characters. Each message unit is comprised of sixteen characters each of which characters may be an alphanumeric character or a blank. Each character stored in the memory means consists of eight binary bits and is referred to as a word, byte of information or a data byte. The addressable location of the memory means at which a character is stored is referred to as a "character location". A more detailed explanation of the above described alphanumeric display system may be had from the above referenced U.S. patent and patent application.

An EEPROM, for example one which might be used in an alphanumeric display system as shown herein, is manufactured by the Intel Corporation and is designated as the 2816. The 2816 provides 16,384 cell locations and each cell location stores a binary bit of data. The cells are arranged in a 128×128 array and are coordinated by rows and columns to form 128 rows and 16 columns with eight cells being in each column of each row. These eight cells of each column of each row store a data byte and are accessed through data terminals on the EEPROM which function as transmitters for both data input and output to and from the EEPROM. It can be seen that one cell row consists of sixteen data bytes or character locations. Because each message unit comprises sixteen alphanumeric characters, the data representing a message unit is contained in one row and the row may be referred to as a message unit storage area and is addressed by an address code associated with the row. The data representing each character in a message unit can be identified by identifying its column. Thus, any character storage location of the EEPROM can be selected by specifying a row and a column address. In the present disclosure, a column address is referred to as a character address and a row address is referred to as a message unit address.

Referring now to FIG. 1, an alphanumeric visual display system which may be used with the EEPROM programmer embodying the present invention is shown generally at 10. The system 10 has a display device 17 with a row of sixteen character stations 13, 13. A controller 116 is connected by a cable 118 to a number of sensors 120, 120 which may, for example, monitor a manufacturing, material handling, chemical or other industrial process. In response to signals generated by the sensors 120, 120, the controller 116 sends a message unit address in a binary coded decimal (BCD) format via cable 114 to the display system 10 to select a message unit stored in an EEPROM 11 which message unit is then displayed on the display device 17. In accordance with different conditions monitored by the controller 116, the displayed message unit may advise an operator of the state of the monitored condition, provide a warning, give an instruction or the like.

An EEPROM programmer embodying the present invention and designated by the numeral 110 is, as shown in FIG. 1, connected to the alphanumeric display system 10 by a cable 112. The EEPROM programmer 110 may be permanently wired to the alphanumeric display system 10 or may be releasably connected to it by means of mating connector bodies provided on one end of cable 112 and on the display system 10, respectively. A feature of the present invention permits the alphanumeric display system 10 to remain on-line while connected to the EEPROM programmer 110 when a mode switch 18 of the programmer is in the NORMAL position; that is, the alphanumeric display system 10 even though connected to the programmer through the cable 112, retains its ability to receive message unit storage location address signals from the controller 116 and to display the corresponding message. When a user desires to alter or enter data in or into an EEPROM character storage location as hereinafter explained, the mode switch 18 is switched to the PROGRAM position. This feature allows the display device 17 of the display system 10 to be utilized for both the programming and message display functions.

Still referring to FIG. 1, a brief overview of the programming procedure will be presented to enable the reader to more fully understand the detailed description of the EEPROM programmer and circuit operation as hereinbelow described. The EEPROM programmer 110 is enabled and operatively connected to the alphanumeric system 10 when the mode switch 18 is in its PROGRAM position. A manually operable message unit selector such as a BCD thumbwheel selector circuit 16 is used to input into the programmer 110 a decimal identifier of the message unit storage location in the EEPROM 11 desired to be accessed, e.g., message unit 68. This feature allows any message unit, including if appropriate a message unit in a multi-message unit message, to be selected. If the EEPROM has been previously programmed, for instance by the manufacturer, the information stored at the character locations of the selected message unit is displayed on the visual display device 17. If the EEPROM is being programmed for the first time, the display may be blank. For purposes of explanation, it will be presumed that the EEPROM has previously been programmed.

Figure 2:
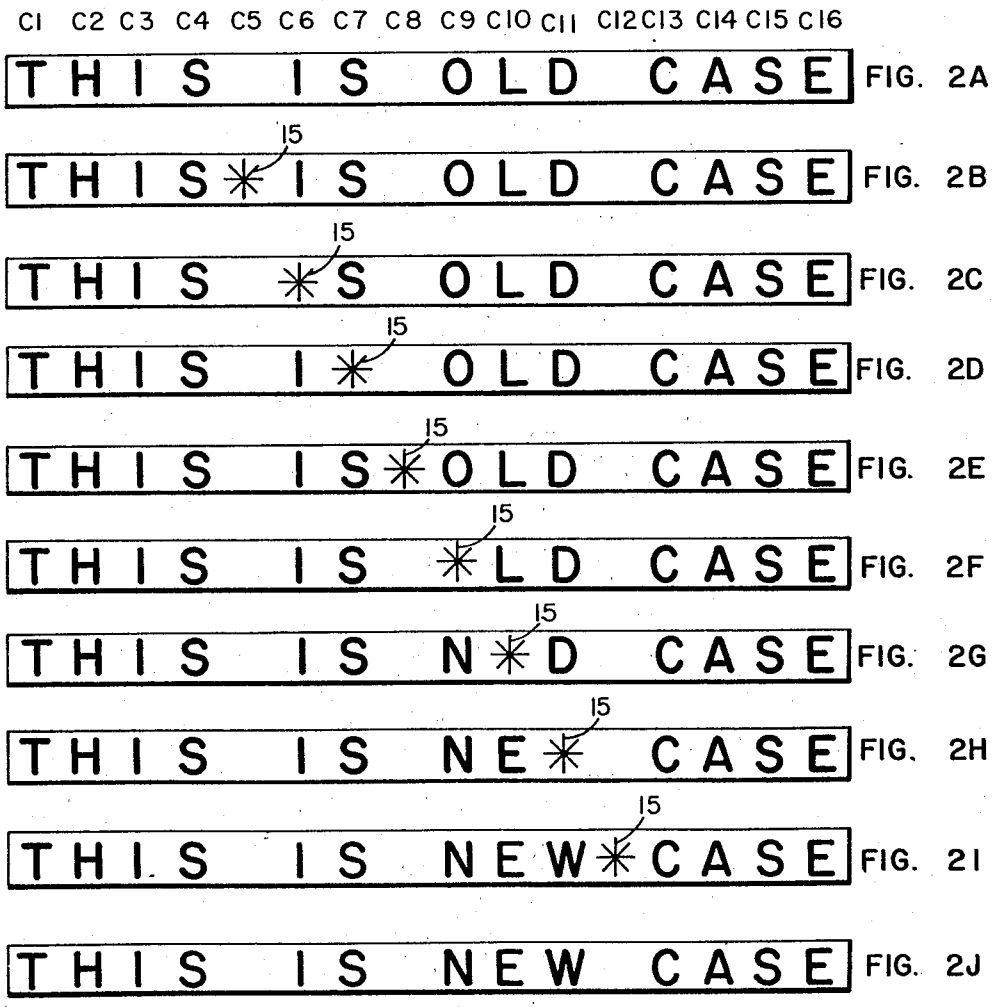
FIGS. 2A to 2J show a series of alphanumeric message displays as the message might appear prior to, during and after altering the EEPROM with the EEPROM programmer of FIG. 1.

An indicating character or cursor such as a star 15, as shown in FIG. 1, will be displayed by one of the character display stations 13, 13 in addition to the remaining characters displayed at the other fifteen character stations to indicate the corresponding EEPROM character location that will contain new or changed data after memory alteration. A character location select switch, such as a push button switch 20, is used to move the cursor 15 sequentially from one character display station to another in the direction of arrow 19 with the cursor 15 being moved one station for each switch operation. A data entry means such as a keyboard 50 is used to enter a two place hexadecimal number representative of a desired alphanumeric character to be written into the selected EEPROM cell locations. A write program switch 88 is operated to cause the entered data to be actually written into the EEPROM cell locations of the character selected by switch 20. The operation of the write program switch 88 also causes the cursor 15 to move automatically to the next adjacent character station to the right as shown in FIG. 2 after the entered data is written into the EEPROM. Data cannot be written into the EEPROM unless an examine switch 56 is in its OFF position, in which it enables an ERASE, WRITE function as explained in greater detail below. Selected message units may be viewed on the display device 17 without the appearance of the cursor 15 by setting the examine switch 56 to its LOCKOUT position. In the LOCKOUT position of the switch 56 the EEPROM programmer 110 is inhibited from altering the contents of any EEPROM cell location. Thus, as a safety feature, programming may be prevented by using a key-lock type single pole-single throw switch for the examine switch 56. Such a switch requires a key to change between the LOCKOUT position and OFF position and because programming can only occur when the examine switch 56 is in the OFF position, the switch 56 may be locked in the LOCKOUT position to prevent unauthorized, unwanted or accidental programming.

Turning now to FIGS. 2A through 2J and still referring to FIG. 1, FIG. 2A shows a typical message unit as it might appear on a sixteen character station display device with the character stations being labeled C1 through C16 for purposes of explanation. When the EEPROM programmer 110 is enabled by setting the mode switch 18 to the PROGRAM position and the examine switch 56 to the OFF position, the displayed message unit shows the cursor 15 in one of the character stations. The character station showing the cursor will be the last character station selected by a character location select circuit as explained in greater detail below.

The following example is illustrative of a typical sequence for reprogramming the message of FIG. 2A to the message of FIG. 2J wherein the character storage locations in the EEPROM corresponding to the character stations C9 through C11 are changed from the letters "0, L, D" to "N, E, W". As stated above, the examine switch 56 is set to the OFF position to permit data to be written into the EEPROM. When a selected message unit is first displayed, the cursor 15 appears in one of the character display stations which is character station C5 in the illustrated example as shown in FIG. 2B. The cursor 15 is moved, by pushing the switch 20 four times, from character station C5 to a desired character station C9. Such movement is illustrated by FIGS. 2B to 2F with the cursor shifting one station to the right with each push of the switch 20. The two place hexadecimal number for the letter "N" is now entered on the keyboard 50 and the write program switch 88 is then operated to cause a binary signal representation of the letter "N" to be written into the EEPROM cell locations associated with character station C9 for the selected message unit with the prior contents of the eight cells of the data byte being erased at the same time. The displayed message unit, as illustrated in FIG. 2G, now has the letter "N" in the character station C9 and the cursor 15 in the next station C10. The two place hexadecimal number for the letter "E" is now entered on the keyboard 50 and the write program switch 88 is again operated causing the corresponding EEPROM cells to be first erased and then have written into them a binary representation of the letter "E". The displayed message unit, as illustrated in FIG. 2H, now displays the letter "E" in the character station C10 and the cursor 15 in station C11. The process is then repeated to write the letter "W" into the EEPROM cell locations corresponding to character station C11 and the resulting displayed message unit is as shown in FIG. 2I. FIG. 2J illustrates the reprogrammed message unit as displayed on the display device when the examine switch 56 is returned to the LOCKOUT position to display all sixteen stored characters without the cursor.

Figure 3:
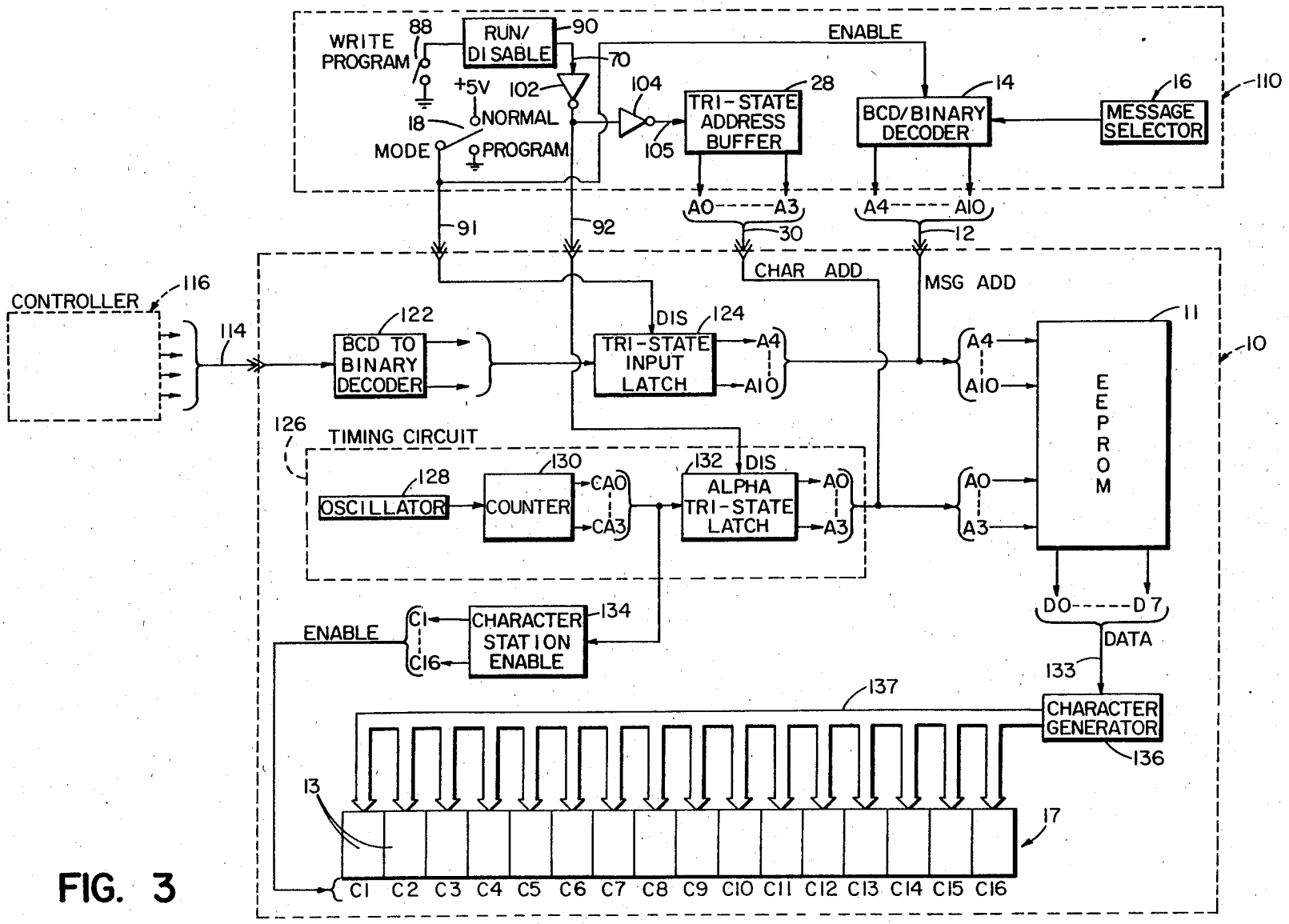
FIG. 3 is a diagram, partly in block form and partly in schematic form, of an alphanumeric display system connected to an EEPROM programmer embodying the present invention.

Turning now to FIGS. 3 and 4, the EEPROM programmer 110 is shown connected to the alphanumeric display system 10 which operates generally as follows. The associated controller 116 selects a complete message by providing a BCD signal, on the multiple conductor lead 114, to a BCD to binary decoder 122 in the alphanumeric display system 10. The output of the decoder 122 is fed to a tri-state input latch 124 which when enabled provides a binary coded message address on a multiple conductor MSG ADD lead A4–A10 to the EEPROM 11 input address terminals also designated A4–A10. A timing circuit 126 comprising an oscillator 128 driving a counter 130 generates a four bit character address code on a multiple conductor lead CA0–CA3 and is fed to the input of an alpha tri-state latch 132. When the tri-state latch 132 is enabled, a character address is sent to the EEPROM 11 character address terminals A0–A3 on a multiple conductor CHAR ADD lead A0–A3 to address, in combination with the message unit storage location address, a specific character storage location in the EEPROM 11, that is, one of the characters of the addressed message unit. The contents of the eight cells of the selected character location are fed, on a multiple conductor DATA lead 133 connected to the EEPROM 11 data terminals D0–D7, to a character generator 136 which converts them from the code in which they are stored to a set of binary signals on a character bus 137 to individually drive the display segments of a character station 13. The character address signals CA0–CA3 from counter 130 also drive a character station enable circuit 134. This circuit 134 is 4 to 1 out of 16 converter providing an enabling signal which sequentially shifts, in time with the counter, over the lines C1–C16 to sequentially enable the display stations 13, 13 in such a manner that each individual station 13 is enabled at the same time as the character bus 137 contains the set of binary signals intended for it to cause the characters of the selected message unit to be displayed by the stations 13, 13. In other words, character station 13 (C1) is enabled when the EEPROM 11 is addressed to output the byte of data representing character 1 of the selected message unit to the character generator 136 to in turn cause the appearance of a corresponding set of binary signals on the character bus 137. Character station 13 (C2) is enabled when the data byte associated with character 2 of the selected message unit is outputted from the EEPROM to cause the appearance of a corresponding set of binary signals on the character bus 137, and so forth through to character 16 after which the entire process is repeated starting again with character 1.

Considering now the operation of the EEPROM programmer 110 in greater detail, the decimal identifying number of a desired message unit is manually inputted via the BCD thumbwheel selector circuit 16 which generates a BCD coded signal representation of the selected identifying number. Since the EEPROM 11 requires a binary coded address, a BCD to binary decoder 14 is used to provide the appropriate conversion. The output of the decoder 14 is transmitted via the address leads A4–A10 of the multiple conductor lead 12 to the corresponding MSG ADD leads A4–A10 of the alphanumeric display system 10. The address leads A4–A10 of the EEPROM programmer 110 are therefore functionally and electrically in common with the MSG ADD leads A4–A10 of the display system 10. The message unit identifying number specified by the message selector 16 is transmitted as a binary coded address signal to the EEPROM 11 when the mode switch 18 is set to its PROGRAM position at which it connects a low signal to lead 91 enabling the BCD to binary decoder 14. Lead 91 is also connected to the DIS input of the tri-state input latch 124 and causes the latch 124 to switch to its high impedance mode to effectively disconnect its output from the MSG ADD leads accordingly from and the EEPROM 11 input address terminals A4–A10. Consequently, when the mode switch 18 is in the PROGRAM position, message units stored in the EEPROM 11 can be selected only by operation of the EEPROM programmer 110.

A character address select generator 22 comprising a triggering means and a steppable binary counter generates a four bit address code on a multiple conductor AD0–AD3 lead 24 which is connected to a tri-state address buffer 28 and to an address comparator circuit 26. The character location select switch 20 is connected to the input of the character generator 22 and causes the output count of the counter to increment each time the select switch 20 is operated until the count 16 is reached at which time the counter resets and starts the count from 1. The character generator 22 provides an address code corresponding to each of the sixteen character locations in the EEPROM 11 of a stored message unit.

The address comparator 26 also receives via a multiple conductor lead 30 connected to the CHAR ADD lead A0–A3, a four bit address code generated by the timing circuit 126 in the alphanumeric display system 10. The address comparator 26 generates an ADD MATCH output signal on lead 34 when the character address received from the alphanumeric display system 10 matches the character address generated by the character address generator 22. The address buffer 28 is in its high impedance state at this time and is effectively disconnected from the CHAR ADD lead A0–A3 and the EEPROM 11 character address input A0–A3.

A cursor generator shown in function block 46 comprises a series of tri-state buffer amplifiers wired to produce the hexadecimal number 2A which when decoded by the EEPROM 11 causes the character generator 136 to provide a binary coded signal representative of a star on the character bus 137. The star is used as a cursor and will be displayed at the selected character display station when that station is enabled. When the output of NOR gate 42 produces a high signal on the ENABLE lead 32 in response to the presence of the ADD MATCH signal at its input as explained below the cursor generator 46 is enabled and at such time places the hexadecimal number 2A on the multiple conductor DATA lead 48 which is connected to the EEPROM data input terminals D0–D7. The data byte representative of the character information stored in the EEPROM 11 at the addressed character location and normally displayed at the corresponding character display station 13 is repressed by deselecting the EEPROM 11. The EEPROM is deselected when the EEPROM chip enable (CE) input is brought to a high signal allowing data on the multiple conductor DATA lead 48 to be strobed through the EEPROM when the EEPROM OE input is at a low signal. The output enable (OE) lead 70 is connected to and held low by the output of a run/disable pulse generator 90. Consequently, by maintaining the OE lead 70 at a low signal, data appearing on the multiple conductor DATA lead 48 can be strobed through the EEPROM 11 at a given character address by bringing the EEPROM CE input to a high signal. When the CE lead 36 which is connected to the EEPROM CE input is brought low, the EEPROM 11 is selected and data contained in the selected address memory location is strobed to the EEPROM output in the normal manner and is caused to be displayed as an alphanumeric representation on the display device 17.

The output of NOR gate 42 will produce a high signal on lead 32 to enable the cursor generator 46 when both inputs to the gate are low. One input to the NOR gate 42 is connected to the ADD MATCH lead 34 from the output of comparator 26 and will be a low signal each time an address match occurs. The other input to NOR gate 42 is connected to the output of inverter 43 by lead 44 and is held at a low signal at this time. The inverter 43 is fed from the output of a NOR gate 64. One input to NOR gate 64 is connected to the output of the run/disable pulse generator 90 by lead 70 and is held low at this time. The other input to NOR gate 64 is connected to ground through resistor 57 by lead 58.

The signal on CE lead 36 is generated by the output of NOR gate 40 as follows. One input to NOR gate 40 is connected to the output of the run/disable pulse generator 90 by lead 70 and is held low. The other input to NOR gate 40 is connected to the output of OR gate 38. One input to OR gate 38 is connected by lead 58 to ground through resistor 57 holding that input at a low signal. The other input to OR gate 38 is connected to the ADD MATCH lead 34 and will be at a low signal when the ADD MATCH signal is generated by the comparator 26. Therefore the output of OR gate 38 will follow the transitions of the ADD MATCH signal and will cause the output of NOR gate 40 driving the EEPROM CE input to also follow the ADD MATCH signal transitions to deselect the EEPROM 11 each time the alphanumeric system generated character address matches the EEPROM programmer generated character address. This permits data on the multiple conductor DATA lead 48 rather than the data byte stored in the character storage location in the EEPROM 11 to be displayed at the character station 13 corresponding to the matched address.

Keyboard 50 is used to enter the two place hexadecimal number representation of an alphanumeric character to be written into memory. The output of the keyboard 50 is fed to a keyboard encoder 52 which converts the keyboard signals to the proper binary coded format. The binary coded signals comprising an eight bit byte of data are then fed on a multiple conductor lead 53 to the input of a tri-state, eight bit program data latch 54. The data latch 54 is enabled by a low signal on lead 84 and at such time places the data on the multiple conductor DATA lead 48. The data placed on the multiple conductor DATA lead 48 will be transferred to the data terminals D0–D7 of the EEPROM 11 during the WRITE cycle as explained below in conjunction with the ERASE, WRITE function.

Unlike erasable programmable read-only-memories (EPROM) which are erased by exposure to ultraviolet light for a substantial period of time (typically thirty minutes) to erase the EPROM's entire memory, the EEPROM may be erased one byte at a time in a relatively short time period (ten milliseconds). In order to write new data to the EEPROM, the EEPROM cell locations selected to receive the data must be erased or otherwise conditioned prior to entering a data byte. The term ERASE signifies that the selected EEPROM cells are brought to a logic 1 or a high signal to set the EEPROM cells to the proper signal state to receive a data byte. In the present invention an ERASE code generator 76 comprising a series of tri-state buffer amplifiers are wired to produce the hexadecimal number "FF", which when enabled by a high signal on lead 74 connected to the output of an erase latch enable timer 68, causes the erase generator 76 to provide a high signal to each of the data terminals D0–D7 of the EEPROM 11 via the multiple conductor DATA lead 48. The binary signals representing the ERASE code are strobed into the EEPROM 11 during the ERASE, WRITE cycle as described below.

Data is written into the EEPROM 11 during the ERASE, WRITE cycle as follows. A write program switch 88 is operated and provides a ground to the input of the run/disable pulse generator 90 and causes the generator to produce a positive transition pulse at its output on lead 70 which is connected to the input of an inverter 102. The output of inverter 102 is a negative voltage pulse and is fed via lead 92 to the DIS terminal of the alpha tri-state latch 132 causing the latch 132 to be set to its high impedance state and effectively disconnecting its output from the CHAR ADD multiple conductor lead 30 and accordingly, the character address terminals A0–A3 of the EEPROM 11. The output of inverter 102 also feeds the input of inverter 104 which provides a high signal on lead 105 to enable buffer 28 which at such time places the four bit address code generated by the character address generator 22 onto the CHAR ADD multiple conductor lead 30 which is connected to address terminals A0–A3 of the EEPROM 11. Consequently, the selected character address of the memory location in the EEPROM 11 provided by the address buffer 28 does not change for the duration of the pulse generated by the run/disable pulse generator 90. At the completion of the pulse, the output of the run/disable pulse generator 90 returns to a low signal causing inverter 102 to provide a high output signal fed via lead 92 to the DIS input of the alpha tri-state latch 132 enabling the latch output to be reconnected to the CHAR ADD multiple conductor lead 30. The address buffer 28 is disconnected from the CHAR ADD multiple conductor lead 30 since the high output signal from inverter 102 causes inverter 104 to produce a low signal on lead 105 causing buffer 28 to be set to its high impedance mode.

The time duration of the run/disable generated pulse is set to approximately 150 milliseconds to allow ample time for the ERASE, WRITE circuitry to operate. During the 150 millisecond pulse, the OE lead 70 is held at a high signal to disable the EEPROM 11 output and the CE lead 36 connected to the output of NOR gate 40 is held at a low signal because one input to NOR gate 40 is connected to lead 70. Therefore, the EEPROM 11 is properly conditioned for memory alteration during the ERASE, WRITE cycle.

The operation of the write program switch 88 also triggers a timer 66 which introduces a delay of approximately of ten milliseconds before the erase latch enable timer 68 is triggered to allow for switching delays associated with turn-on and turn-off times of the semiconductor devices. The erase enable timer 68 produces a pulse of approximately thirty milliseconds at its output on lead 74 which enables the erase code generator 76 output terminals D0–D7 to be connected to the multiple conductor DATA lead 48. The pulse on lead 74 is also fed to one input of a NOR gate 94 which produces a high signal at its output on lead 95 to trigger a program pulse timer 96. The output of the pulse timer 96 is a precisely timed ten millisecond pulse on lead 97 which triggers a high voltage program pulse generator 98. The high voltage program pulse generator 98 is of the type generally recommended by EEPROM manufacturers to produce a VPP programming voltage pulse to ensure that the EEPROM cells in question are properly energized to retain a data byte entered via the data input leads D0–D7. The generator 98 produces a twenty-one volt program pulse on the VPP lead 100 which is connected to the EEPROM VPP program terminal to cause the hexadecimal number "FF" (all highs) presented on the multiple conductor DATA line 48 by the erase code generator 76 to be written into the EEPROM memory. At the end of the thirty millisecond pulse the erase code generator 76 is again returned to its high impedance state and timer 86 is triggered to produce a ten millisecond delay pulse to allow for switching device turn-on and turn-off delays before a write data latch enable timer 78 is triggered. The output of the write data latch enable timer 78 is a thirty millisecond positive transition pulse on lead 80 which is connected to the other input of NOR gate 94 and to the input of an inverter 82. The output of inverter 82 is connected to the enable terminal of the program data latch 54 by lead 84 and produces a low signal to enable the latch 54 to connect its output to the multiple conductor DATA line 48. The output of NOR gate 94 again produces a low signal on lead 95 to trigger the program pulse timer 96. A high voltage program pulse is generated on the VPP lead 100 as explained above and causes the data byte appearing on the EEPROM data input terminals D0–D7 to be written into the selected EEPROM cells. The program data latch 54 is returned to its high impedance state and is effectively disconnected from the multiple conductor DATA line 48 at the end of the thirty millisecond pulse generated by the write data latch enable timer 78 because the input to inverter 82 is again low causing the output of inverter 82 on the data latch enable lead 84 to go to a high signal.

At the termination of the 150 millisecond pulse produced by the run/disable pulse generator 90, the character address select generator 22 is incremented as previously explained. The OE lead 70 is again at a low signal which enables the EEPROM 11 output and the CE lead 36 again follows the transitions of the ADD MATCH signal from the address comparator 26. The new data byte written into the selected character storage location is displayed as an alphanumeric representation in the character station corresponding to that character location and the cursor appears in the next adjacent character station.

As explained above, the selected message unit may be viewed without the cursor appearing by operating the examine switch 56 to its LOCKOUT position to connect +5 volts to one input of the NOR gate 64 and to one input of OR gate 38. A high signal at the one input of NOR gate 64 causes the NOR gate 64 to produce a low signal at its output which is connected to the input of inverter 43. The output of inverter 43 produces a high signal on lead 44 which is connected to one input of NOR gate 42. The output of NOR gate 42 produces a low signal on the cursor generator enable lead 32 to keep the cursor generator 46 in its high impedance state and effectively disconnected from the multiple conductor DATA line 48 and accordingly, the EEPROM 11. Since one input to OR gate 38 is also held high, the output of OR gate 38 will remain high and will not follow the transitions of the ADD MATCH signal on lead 34. The output of NOR gate 40 will remain low keeping the EEPROM CE input low and the EEPROM 11 will be selected to provide display information for every character station.

Operating the examine switch 56 to its LOCKOUT position also connects +5 volts to one input of NOR gate 60 on lead 58. The output of NOR gate 60 is connected to the enable input of timer 66 by lead 73 and will be a low signal to prevent timer 66 from generating an output pulse when the write program switch 88 is operated. The output of NOR gate 60 will also be a low signal and keep the timer 66 disabled when the mode switch 18 is in its NORMAL position which connects +5 volts to the other input to NOR gate 60 via lead to 91.

An EEPROM programmer using an alphanumeric display system has been described in one preferred embodiment; however, numerous modifications and changes may be had without departing from the spirit of the invention. Therefore, the invention has been described by way of illustration rather than limitation.

I claim:

1. Apparatus for programming an electrically erasable programmable read-only-memory (EEPROM) semi-conductor memory device wherein said EEPROM is part of an alphanumeric display system having a multi-character station visual display device for displaying message units each made up of a plurality of characters wherein each character of the message unit is stored at an adressable character location as a byte of data in cells of said EEPROM, said EEPROM having a plurality of address terminals divided into two groups where one group is energized by a binary coded message unit address signal to address any one of a plurality of message units into which the stored characters are divided and the other group is energized by a binary coded character address signal to address any one of the character locations of the addressed message unit, said display system also including a first message unit addressing means for generating a message unit address signal to address one of the message units of said EEPROM, and said display system further including a first character addressing means for generating a character address signal to address one of the characters of the addressed message unit of said EEPROM, said apparatus comprising:

second message unit addressing means for generating a message unit address signal to address one of the message units of said EEPROM;

means for selectively connecting or disconnecting said EEPROM to or from said first message unit addressing means and for simultaneously disconnecting or connecting said EEPROM from or to said second message unit addressing means so that stored message units are addressed by one or the other of said first and second message unit addressing means;

second character addressing means for generating a character address to address one of the character storage locations of the addressed message unit;

means for selectively connecting or disconnecting said EEPROM to or from said first character addressing means and for simultaneously disconnecting or connecting said EEPROM from or to said second character addressing means so that character storage locations are addressed by one or the other of said first and second character addressing means;

means for comparing a character address generated by said first character addressing means to a character address generated by said second character addressing means to produce an ADD MATCH signal, said ADD MATCH signal being representative of a character address generated by the first generating means being the same as a character address generated by the second generating means;

means for generating an indicator character signal representative of a cursor in response to the presence of said ADD MATCH signal, said cursor being displayed in the character display station position corresponding to the character address generated by said second character addressing means;

means for conditioning an addressed EEPROM character storage location to receive a data byte;

alphanumeric character generating means associated with the EEPROM programming apparatus for generating a signal representative of an alphanumeric character to be written into an addressed and conditioned EEPROM character storage location, and storage location altering means responsive to said conditioning means and said programming apparatus alphanumeric character generating means for electrically altering said addressed and conditioned EEPROM character storage location to cause it to retain said signal representative of an alphanumeric character generated by said programming apparatus alphanumeric character generating means.

2. Apparatus for programming as defined in claim 1 wherein said second message unit addressing means includes means for inputting a decimal identifying number associated with a message unit wherein each different message unit is associated with a different decimal identifying number, and means for converting said number to a binary coded signal recognizable by said EEPROM.

3. Apparatus for programming as defined in claim 1 wherein said second character location addressing means includes a triggering means and a counter wherein the counter output is a four bit character address code and said counter is responsive to said triggering means and the character address code present at its output can be sequenced to any one of sixteen character addresses associated with the character storage locations of a selected message unit and each character address corresponds to a predetermined character display station position.

4. Apparatus for programming as defined in claim 3 wherein said counter output is incremented each time said memory altering means operates to alter a character storage location so that said counter output corresponds to the character storage location address of the next adjacent character display station position.

5. Apparatus for programming as defined in claim 1 wherein said apparatus includes means for disabling said storage location altering means so that the storage locations containing signals representative of the alphanumeric characters comprising a selected message unit are prevented from being altered.

6. Apparatus for programming as defined in claim 1 wherein said alphanumeric character generating means is manually operable.

7. Apparatus for programming as defined in claim 1 wherein said EEPROM further includes a chip enable (CE) terminal which may be energized by a low voltage signal to select or a high voltage signal to deselect the EEPROM, a plurality of data terminals, said data terminals being connected to and disconnected from the EEPROM cells of an addressed character location, an output enable (OE) terminal which may be energized by a low voltage signal to connect and a high voltage signal to disconnect the EEPROM cells of an addressed character location to and from said data terminals, and a VPP program terminal for receiving a voltage program pulse for energizing the cells of the EEPROM to write a data byte appearing on said EEPROM data terminals into the corresponding cells in an addressed character location when the EEPROM is selected, and said storage location altering means including a pulse generator for producing said voltage program pulse, said pulse generator being responsive in a timed relationship first to said conditioning means wherein said conditioning means provides a high signal to each of said data terminals for causing the EEPROM cells in an addressed character location to be set to a high voltage signal and then responsive to said programming apparatus alphanumeric generating means wherein said programming alphanumeric generating means provides the binary signal representative of an alphanumeric character to said data terminals for causing the EEPROM cells in an addressed and conditioned character location to be set to the signal representative of the generated alphanumeric character.

* * * * *